United States Patent [19]

Hunter

[11] 3,972,252

[45] Aug. 3, 1976

[54] TOP TURN RATCHET

[76] Inventor: John K. Hunter, 9035 O'Neil Drive, Hinsdale, Ill. 60521

[22] Filed: Jan. 12, 1976

[21] Appl. No.: 648,648

[52] U.S. Cl. ..... 81/57.29
[51] Int. Cl.[2] ..... B24B 17/00
[58] Field of Search ..... 81/57.29, 58.1

[56] References Cited

UNITED STATES PATENTS 1,416,271 5/1922 Devos ..... 81/57.29

FOREIGN PATENTS OR APPLICATIONS 500,185 11/1954 Italy ..... 81/57.29

*Primary Examiner*—James L. Jones, Jr.

[57] ABSTRACT

An extended ratchet designed to readily obtain access for tightening or loosening nuts or bolts located within tight or "hard to get at" places with the shaft of the ratchet being turned in the same axis as the ratchet handle rather than a side to side motion, the top turn ratchet consisting of a cylindrical and hollow handle through which is assembled a round shaft with provisions on one end for turning the shaft by means of a T-type handle, by an open end or crescent wrench, or by a conventional ratchet wrench, and with the shaft being affixed on its opposite or driving end with a beveled gear interconnected to a second beveled gear to transfer the drive force in a direction perpendicular to the axis of the drive shaft. The beveled gears are contained within a housing which is provided with openings for access to the beveled gears for purposes of assembly of the beveled gears therein and for maintenance of said gears, with the openings being round and threaded for the easy attachment or removal of round protective covers over said openings. The top ratchet can also be used to obtain access within tight areas for the assembly or removal of bolts or nuts from either end of the ratchet.

5 Claims, 6 Drawing Figures

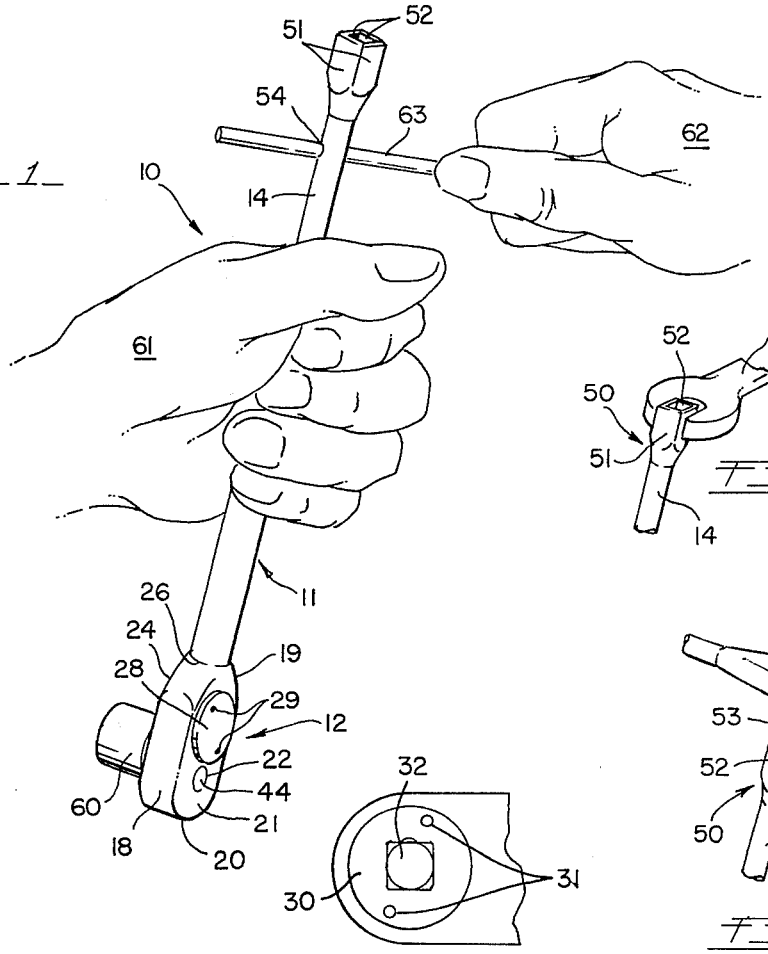
FIG. 1
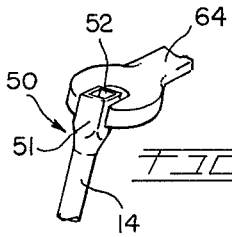
FIG. 6
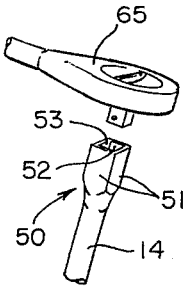
FIG. 5
FIG. 4
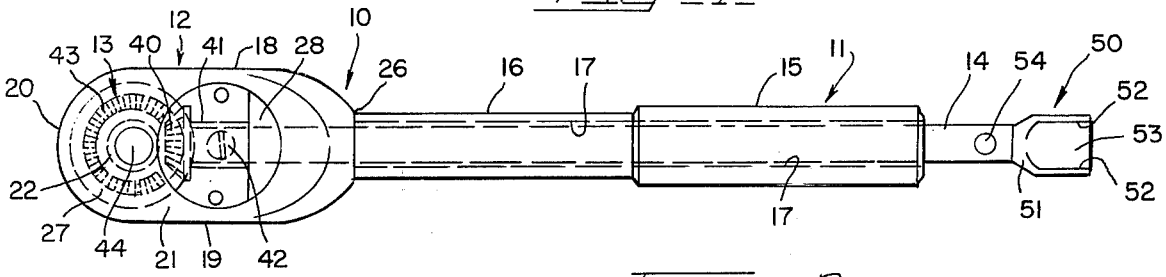
FIG. 2
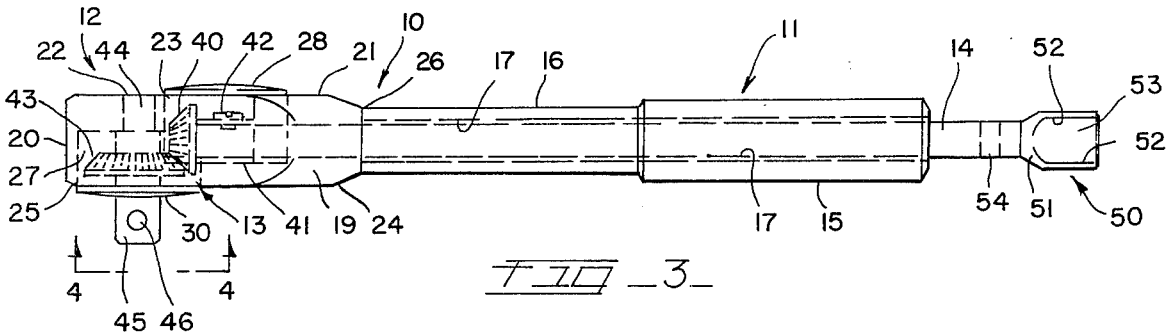
FIG. 3

TOP TURN RATCHET

BACKGROUND OF THE INVENTION

1. Field of the Invention

This invention relates to a ratchet for ease of tightening or loosening nuts or bolts in tight places.

2. Description of the Prior Art

It has always been an aggravating task for individuals, such as mechanics, to readily obtain access within close places to bolts or nuts in order to loosen or tighten said bolts or nuts, this most often being done with conventional type wrenches provided with solid or flexible extensions thereof. Conventional ratchet wrenches are often used to gain access to nuts and bolts in tight areas, but conventional ratchets are operated with a side to side motion with hindrances of one type or another often making necessary many manipulations of the ratchet wrench in order to tighten or loosen a nut or bolt. There is thus an obvious need in the marketplace for a ratchet type wrench which can readily be positioned over a nut or bolt in tight areas for loosening or tightening thereof and which can be turned freely away from any obstacles.

SUMMARY OF THE INVENTION

The present invention provides a novel top turn ratchet for the tightening or loosening of nuts or bolts in tight areas that can be easily and readily positioned over such nuts or bolts and which can be easily turned without any obstacles thereto.

It is a feature of the present invention to provide a ratchet for efficient use in loosening or tightening bolts or nuts in tight areas.

A further feature of the present invention provides a top turn ratchet which is easy to use and reliable and efficient in operation.

Yet still a further feature of the present invention provides a top turn ratchet which is of a rugged and durable construction and which, therefore, may be manufactured by the manufacturer to withstand rough and continual usage.

Other features of this inventon will be apparent during the course of the following description.

BRIEF DESCRIPTION OF THE DRAWINGS

In the accompanying drawings forming a part of this specification, and in which like reference characters are employed to designate like parts throughout the same:

FIG. 1 is a perspective view of the top turn ratchet as held in the user's hands and being operated by a T-shaped handle; and FIG. 2 is a front cut-away view of the top turn ratchet showing the internal mechanisms therein; and FIG. 3 is a side cut-away view of the top turn ratchet showing the internal mechanisms therein; and FIG. 4 is an end sectional view of the male drive shaft opening; and FIG. 5 is a sectional view of the top end of the top turn ratchet as adaptable to a conventional ratchet wrench; and FIG. 6 is a top sectional view of the top turn ratchet as adaptable to a conventional open end or crescent wrench.

DESCRIPTION OF THE PREFERRED EMBODIMENT

Referring now to the drawings in detail, there is illustrated a preferred form of the top turn ratchet constructed in accordance with the principles of the present invention and which is designated generally in its entirety by the reference numeral 10 and which is comprised of a handle 11, a gear housing 12, a gear assembly 13, a drive shaft 14, and associated components as will be later described.

The handle 11 is constructed of durable material, such as hardened steel, and is cylindrical in form and, as shown in FIGS. 2 and 3, has an outside gripping surface 15, an outside surface 16 being of less diameter than the outside gripping surface 15 and extending from the end of the outside gripping surface 15 to the gear housing 12, and an inside surface or diameter 17 providing a round opening through the length of the handle 11.

As shown in FIGS. 1, 2, and 3, the gear housing 12 is also constructed of durable material, such as hardened steel, and is manufactured out of a single piece of material consisting of ends walls 18 and 19, a bottom wall 20, a side wall 21 which is provided with a round through hole 22 and a round threaded hole 23 (threads not shown), and a side wall 24 which is provided with a round threaded hole 25 (threads not shown). The end walls 18 and 19, the side wall 21, and the side wall 24 are rounded at their top ends to form the rounded top end 26 to match the outside surface 16 of the handle 11 with the top end 26 of the gear housing 12 being securely affixed, such as by welding or by the gear housing 12 and the handle 11 being integrally manufactured from the same piece of material. The gear housing 12 is milled out to form the interior compartment 27 therein for assembly of the gear assembly 13 and the drive shaft 14 thereto. The round threaded hole 23 in the side wall 21 of the gear housing 12 is sealed by the round threaded cap 28 which is provided with two round holes 29 on its top surface. The round threaded hole 25 in the side wall 24 of the gear housing 12 is sealed with the round threaded cap 30 which is provided with two round holes 31 and a square through hole 32.

The gear assembly 13 consists of a primary gear 40 with the gear teeth, as shown in FIGS. 2 and 3, being beveled with the flat side of the gear 40 being securely affixed to a short length of round tubing 41 which is assembled in a conventional way by means of a set screw 42 to the end of the drive shaft 14. The drive gear 43 is also beveled with its gear teeth meshing with the gear teeth of the primary gear 40 with the drive gear 43 being securely adjoined centrally on its gear teeth surface to the round solid shaft 44 which is positioned through the round through hole 22 in the side wall 21 of the gear housing 12, with the flat end of the drive gear 43 being securely adjoined at its center to the square drive shaft 45 which is provided with a convention spring-loaded pin 46 and with the drive shaft 45 being positioned through the square through hole 32 of the round threaded cap 30 to protrude externally from the side wall 24 of the gear housing 12.

The drive shaft 14 consists of a solid round shaft with one end being blunt and, as described above, being attached to the primary gear 40 by means of the set screw 42, with the top end of the shaft being securely adjoined to a section of square tubing 50 with four outside walls 51 and four inside walls 52 to form the square hole or opening 53 therein. The drive shaft 14 is also provided with a round through hole 54 near the top of the drive shaft 14 but below the section of square tubing 50.

In operation, the top turn ratchet 10 would be used by an individual to obtain access to a nut or bolt in a tight place, with the user attaching a conventional socket 60 of the size required over the drive shaft 45 of the gear assembly 13, positioning the top turn ratchet within the tight area so that the socket 60 is assembled over the bolt or nut (not shown), the user then grasping the handle 11 on the outside gripping surface 15 with one hand 61 and then turning the drive shaft 14 in the desired clockwise or counterclockwise direction with the other hand 62 by means of either a round shaft 63 positioned through the round hole 54 to form a T-shaped handle thereto, or by means of a conventional open end or crescent wrench 64 positioned on the outside walls 51 of the square tubing 50, or by means of a conventional ratchet type wrench 65 positioned within the square opening 53 of the square tubing 50. If desired in certain cases by the user, the top turn ratchet 10 can be reversed so that the square tubing 50 can be provided with a conventional attachment (not shown) to be secured to the nut or bolt (not shown) with the ratchet being turned with the use of a conventional tool by rotating the drive shaft 44. By rotating the drive shaft 14 in the desired clockwise or counterclockwise direction, the primary gear 40 is turned in the same direction to transfer the force to the drive gear 43, this in turn rotating the drive shaft 45 and the socket 60 attached thereto for loosening or tightening of the bolt or nut as desired. The round threaded caps 28 and 30 can be removed from the gear housing 12 by fitting a conventional type tool into their respective round holes 29 or 31, the caps 28 and 30 being removed for assembly of the gear assembly 13 within the inner compartment 27 of the gear housing 12 or for maintenance or repair thereof, with the caps 28 and 30 being tightly secured onto the gear housing 12 during use for protection of the gear assembly 13.

There is thus provided a novel top turn ratchet which can be readily applied to bolts or nuts in tight places for the loosening or tightening thereof to enable the user to loosen or tighten the bolts or nuts by applying rotational force away from possible obstacles and without the need to move the ratchet from side to side so as to hinder the ratchet movement by obstacles near the bolts or nuts to be tightened or loosened. This invention, then, meets all its stated objectives and overcomes the disadvantages of existing methods.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A top turn ratchet for providing easy access to nuts and bolts in tight places so that the nuts or bolts can be tightened or loosened with rotational force that is not impeded by obstacles adjacent to said nuts or bolts, the device comprising, in combination:

A handle constructed of durable metal tubing having an enlarged outside diameter to provide a gripping surface by the user's hand;

A gear housing being generally rectangular in shape with a rounded top surface to match the outside diameter of the handle to which the gear housing is securely affixed, such as by welding, a hollow interior compartment for assembly of the gear assembly therein, two round threaded holes on opposite sides of the gear housing to provide access to the interior compartment for assembly and maintenance of the gears therein, and with one of the walls also being provided with a round through hole for assembly of a gear shaft therethrough;

A gear assembly consisting of two beveled gears with the primary gear attached on its flat surface to a length of tubing for attachment to the end of the drive shaft with a set screw thereto, and a drive gear to which a round shaft is attached centrally on one end for positioning through a round hole in the gear housing and with a square shaft attached to the other end of the gear protruding externally from the gear housing for attachment of a conventional socket thereto for loosening or tightening bolts or nuts; and A drive shaft consisting of a length of durable metal rod which is secured on one end to the primary gear and is provided on the other end with a square piece of tubing for turning of the drive shaft by means of conventional wrenches and with the drive shaft being provided with a round through hole for insertion of a round shaft therethrough to provide a T-shaped handle for turning of said drive shaft.

2. A top turn ratchet as set forth in claim 1 wherein threaded caps are provided for enclosing the threaded opening in the gear housing to provide protection of the components therein, said caps being removed or assembled to threaded holes by a conventional tool applied to two round holes provided within the top surface of said caps.

3. A top turn ratchet as set forth in claim 1 wherein force is applied to the drive shaft in a rotational direction along the axis of the drive shaft away from obstacles near the bolt or nut to be loosened or tightened, thereby eliminating the need for side to side motion as in a conventional ratchet.

4. A top turn ratchet as set forth in claim 1 wherein a square piece of tubing is affixed to the top of the drive shaft for use in turning said drive shaft with any of a variety of conventional tools, including an open end wrench, a crescent wrench, or a conventional ratchet wrench, with a through hole also being provided through the drive shaft for use in turning said drive shaft by means of a round shaft inserted therethrough to form a T-shaped handle.

5. A top turn ratchet as set forth in claim 1 wherein either end of the top turn ratchet can be used for tightening or loosening of bolts or nuts in tight areas by means of conventional attachments to either end.

* * * * *